US005243955A

United States Patent [19]

Farless

[11] Patent Number: 5,243,955

[45] Date of Patent: Sep. 14, 1993

[54] MECHANICAL SHOOTING APPARATUS

[76] Inventor: Bruce W. Farless, 5001 Creekside Dr., Shingle Springs, Calif. 95682

[21] Appl. No.: 780,089

[22] Filed: Oct. 17, 1991

[51] Int. Cl.[5] ..... F41B 3/02

[52] U.S. Cl. ..... 124/20.1; 124/20.3; 124/22

[58] Field of Search ..... 124/16, 17, 20.1, 20.2, 124/20.3, 21, 22

[56] References Cited

U.S. PATENT DOCUMENTS

| | | | |
|---|---|---|---|
| 2,996,060 | 8/1961 | Appleby | 124/20.1 X |
| 3,057,338 | 10/1962 | Iwamoto | 124/22 |
| 3,269,380 | 8/1966 | Stevens | 124/25 |
| 3,783,852 | 1/1974 | Shepherd | 124/22 |
| 3,857,379 | 12/1974 | Burghardt | 124/20.3 X |
| 4,125,106 | 11/1978 | Kelly | 124/17 |
| 4,169,453 | 10/1979 | Hunsicker | 124/20 R |
| 4,388,914 | 6/1983 | Cesin | 124/27 |
| 4,411,248 | 10/1983 | Kivenson | 124/20 R |
| 4,593,673 | 6/1986 | Kees | 124/20.3 |
| 4,651,707 | 3/1987 | Bozek | 124/17 |
| 4,662,345 | 5/1987 | Stephens | 124/25 |
| 4,703,744 | 11/1987 | Taylor et al. | 124/20 R |
| 4,784,106 | 11/1988 | Kees | 124/20.1 |
| 5,072,715 | 12/1991 | Barr | 124/20.1 |

FOREIGN PATENT DOCUMENTS

| | | | |
|---|---|---|---|
| 396374 | 5/1924 | Fed. Rep. of Germany | 124/20.1 |

*Primary Examiner*—Randolph A. Reese
*Assistant Examiner*—Harry C. Kim
*Attorney, Agent, or Firm*—Joseph E. Gerber

[57] ABSTRACT

A mechanical shooting apparatus is disclosed, the apparatus having an elongate body comprised of two connectedly displaceable body members, the first body member having a pair of opposed pulleys adjacent its rearward end and another pair adjacent its forward end, and further including an elongate track portion on its upper surface. A loop member having a linearly resilient segment is seated against the second body member's forward end, opposing lengths of the loop extending rearwardly around the rearward pulleys, and forwardly around the forward pulleys, a sliding dog being attached to the loop between the forward pulleys and being slidably engaged with the track portion A trigger for holding the sliding dog rearwardly when drawn from between the pulleys, and for suddenly releasing the dog, is provided. A velocity increasing mechanism replacing the sliding dog is also disclosed, the mechanism comprising a ferrule affixed to the loop between the forward pulleys. A length of resilient tube is bound in coaxial relation to the ferrule's rearward end, a cap having a downward-projecting spur being disposed at the rearward end of the tube, and a trigger being provided for holding the cap rearwardly by its spur for sudden release. One embodiment of the velocity increasing mechanism includes a seat interior to the cap for receiving a spear or an arrow. A pellet projecting embodiment of the velocity increasing mechanism includes a rod, the forward end of which is axially slidingly received in the ferrule, the rearward end of which is fixed to the interior of the cap, the rod being of sufficient length such that when the tube is axially elongated, the rod's forward end remains in the ferrule.

15 Claims, 7 Drawing Sheets

MECHANICAL SHOOTING APPARATUS

BACKGROUND OF THE INVENTION

1. Field Of The Invention

The present invention relates generally to mechanical projectors and more specifically to shooting apparatus powered by a linearly-resilient member.

2. Description Of The Related Art

Mechanical projectors employing linearly resilient members to accelerate a projectile span a broad spectrum of complexity. The simplest example of this genera of projectors is the common slingshot, this being comprised of a forked body, the central member of the fork acting as a handle, and each of the arms of the fork having bound to it one end of an elastic strap or tube. Refinement of this basic structure may yield improvements in range and accuracy, but its inherent limitations remain, these including strength of the user, and steadiness and alignment of the hands when drawing the elastic member taut and taking aim.

Devices directed to improving over the common slingshot include that shown in U.S. Pat. No. 4,411,248 issued to Kivenson in 1983. Therein, a compound slingshot is disclosed, this employing a plurality of pulleys for guiding an elastic member. However, accuracy is not maximized in Kivenson's device because the elastic member continues to be drawn and held by hand while taking aim.

Similar limitations are inherent in the related arrow projecting device of Taylor, et al., disclosed in U.S. Pat. No. 4,703,744 issued in 1987; and, in the lever-assisted slingshot disclosed by Bozek in U.S. Pat. No. 4,651,707 issued in 1987.

Accuracy appears improved in an elastic-powered, rifle-like device shown in U.S. Pat. No. 3,783,852 issued to Shepherd in 1974. Therein, an elongate body is provided for steadiness in aiming and a trigger is employed to release the resilient member with more precision than is possible with the naked hand. Further, Shepard's elastic tubing is formed into a loop including a length of nonresilient bowstring, the tubing running alongside the body of the device and the bowstring being stretched across a perpendicular bow. However, whenever a substantial length of such a linear member, be it bowstring or resilient tubing, is oriented perpendicular to the line of flight of the projectile it accelerates, resistance occurs and efficiency is sacrificed. Underwater applications suffer even more noticeably from such resistance. Further, when a bow is oriented perpendicular to the body of a shooting apparatus, it presents the structural problem of mounting the bow securely against the stress it suffers in use and, in any case, makes the apparatus less streamlined. For example, when using such a weapon in wooded areas, a perpendicularly-oriented bow is likely to catch on passing brush, and the like.

Further, the prior devices are adapted to projecting either a pellet or an elongate projectile such as an arrow, but neither is easily convertible between being able to project one, to the other.

Thus, there appears a need for a streamlined mechanical shooting apparatus, being structured so as to maximize accuracy in aiming as well as release, while minimizing friction against the surrounding environment and being easily convertible between projecting pellets and elongate projectiles.

SUMMARY OF THE INVENTION

The shooting apparatus of the present invention is adapted to overcome the above-noted shortcomings and to address the stated needs. In its preferred embodiment, it is comprised of several separately functioning combinations of elements, each combination being inventive in itself and independently capable of accelerating a projectile. Further, each combination is able to interact and cooperate with the others to yield amplified effects.

A first combination comprises an elongate body having two pairs of opposed pulleys, one pair being mounted adjacent its forward end and another pair being mounted adjacent its rearward end. A substantially contiguous flexible loop member, at least a segment of which is linearly resilient, is seated against the body's forward end. Opposing lengths of this loop extend rearwardly and around the rearward pulleys, then forwardly and around the forward pulleys to meet and close the loop. This relation of the body, pulleys and loop permits a short segment on the loop to be drawn rearwardly from between the forward pulleys to create a potential for accelerating a projectile in a forward direction. And, means for suddenly releasing that short segment on the loop are provided.

A second combination comprises first and second elongate body members, the second body member being connectedly displaceable from the first body member. A substantially contiguous flexible loop member, at least a segment of which is linearly resilient, is seated against the forward end of the second body member. And, means are provided on the first body member for selectively restraining and releasing a short segment on the loop whereby, when restrained, connected displacement of the first body member from the second body member adds tension to the loop and yields a potential to accelerate a projectile in a forward direction. Again, means for suddenly releasing that short segment on the loop are provided.

A third combination includes cooperating elements of the first and second combinations and comprises a first elongate body member having two pairs of opposed pulleys, one pair being mounted adjacent its rearward end and another pair being mounted adjacent its forward end. A second elongate body member is connectedly displaceable from the first body member, and a substantially contiguous flexible loop member, at least a segment of which is linearly resilient, is seated against its forward end. Opposing lengths of this loop extend rearwardly and around the rearward pulleys, then forwardly and around the forward pulleys to meet and close the loop. This relation of the first and second body members, the pulleys, and the loop permits a short segment on the loop to be drawn rearwardly from between the forward pulleys to create a potential for accelerating a projectile in a forward direction. Further, connected displacement of the second body member from the first body member adds tension to the loop and yields an increased potential to accelerate a projectile. As above, means for suddenly releasing that short segment on the loop are provided.

A velocity increasing mechanism is adapted to work in concert with any shooting apparatus comprised of the foregoing combinations of elements, and with other shooting apparatus as well, especially those including a linearly resilient member as a primary means for accelerating a projectile. The velocity increasing mechanism first includes a ferrule affixed to the linearly resilient member. The ferrule has forward and rearward ends, its forward end corresponding to that end of the apparatus from which a projectile departs. A length of resilient tube is bound to the ferrule in coaxial relation therewith, at the ferrule's rearward end. Means are provided at the exterior of the rearward end of the tube for permitting that end to be selectively restrained and released.

When used with the first and third separately functioning, projectile accelerating combinations of elements above, the ferrule of this velocity increasing mechanism is fixed to the loop between the forward pulleys. When used with the second combination, the ferrule is fixed to the point on the loop normally restrained by the selective restraining and releasing means on the first body member.

One embodiment of the velocity increasing mechanism includes means interior to said rearward end of said tube for seating a spear or an arrow.

A pellet projecting embodiment of the velocity increasing mechanism includes a rod, the forward end of which is axially slidingly received in the ferrule, the rearward end of which is fixed to the interior of the rearward end of the tube. The rod should be of sufficient length such that when the tube is axially elongated, the rod's forward end remains in the ferrule.

It is an object of the present invention to provide a mechanical shooting apparatus that is compact, yet capable of imparting great velocity to a projectile.

It is a further object of the present invention to provide a mechanical shooting apparatus that is accurate and easy to operate.

Yet another object of this invention is to provide a mechanical shooting apparatus employing a resilient, flexible loop for accelerating a projectile, the loop having a minimum of its length oriented perpendicular to the line of flight of the projectile.

Yet a further object of the present invention is to provide a mechanical shooting apparatus that is easy to cock.

And, an object of an embodiment of the invention is to provide a mechanical shooting apparatus that includes two cocking stages, a first for which finger tension is sufficient, and a second for which arm strength is required.

Still a further object of the present invention is to provide a mechanical shooting apparatus able to shoot elongate projectiles such as spears and arrows, while also being able to shoot pellets with minor modification.

Another object of the present invention is to provide a mechanical shooting apparatus having a secondary, velocity increasing apparatus able to supplement the acceleration imparted to a projectile by a primary shooting mechanism.

Still further objects of the inventive mechanical shooting apparatus disclosed herein will be apparent from the drawings and following detailed description thereof.

DESCRIPTION OF THE PREFERRED EMBODIMENTS

Figure 1:
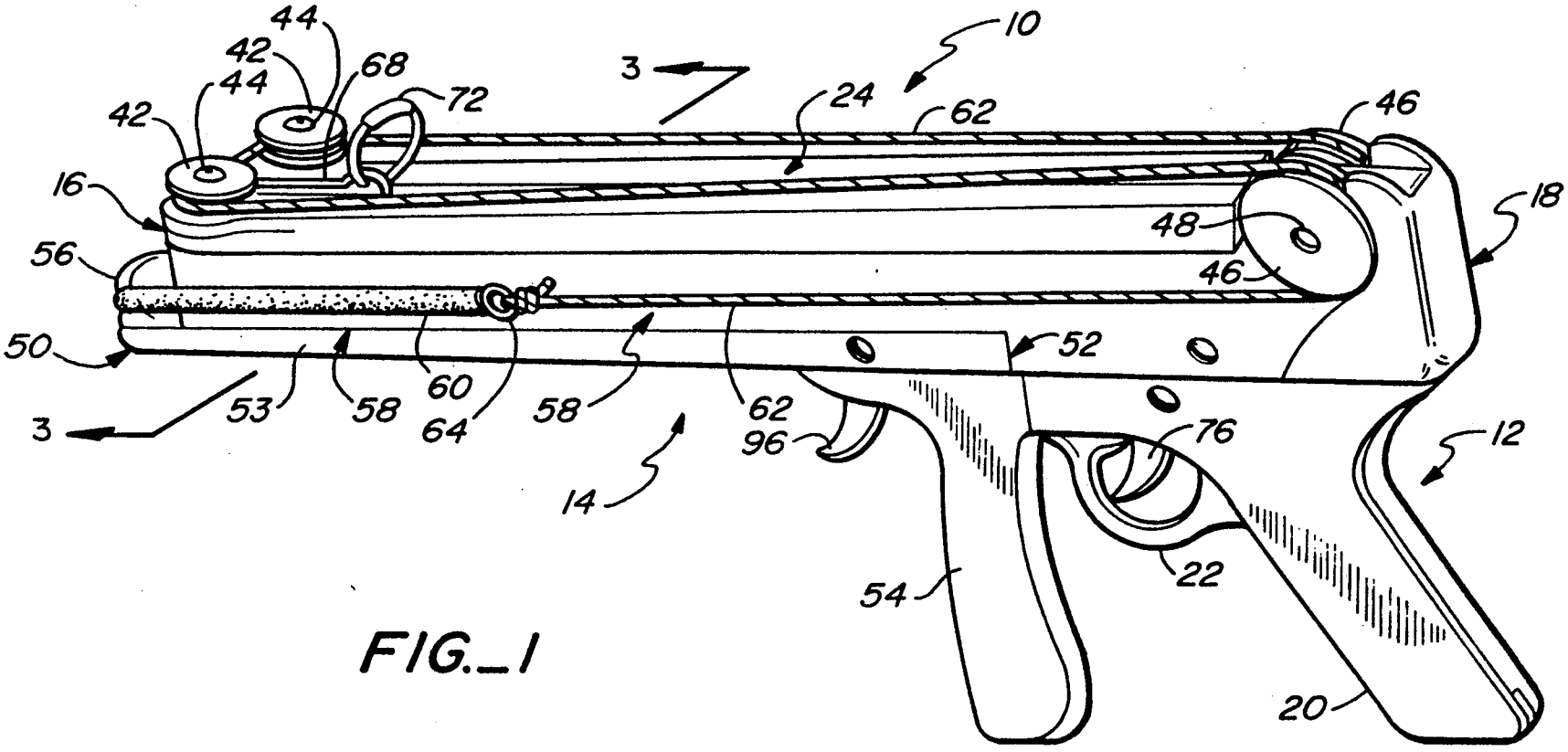
FIG. 1 is a perspective view of a mechanical shooting apparatus in an uncocked posture.

Referring now specifically to the drawings, FIG. 1 shows the mechanical shooting apparatus of the present invention, the apparatus being generally identified herein by reference numeral 10. Apparatus 10 is comprised of a first body member 12 and a second body member 14, the second body member being nested beneath the first. Members 12 and 14 of apparatus 10 may be constructed of any durable, rigid material, laminated acrylic having been used with success in practicing the invention.

Figure 1A:
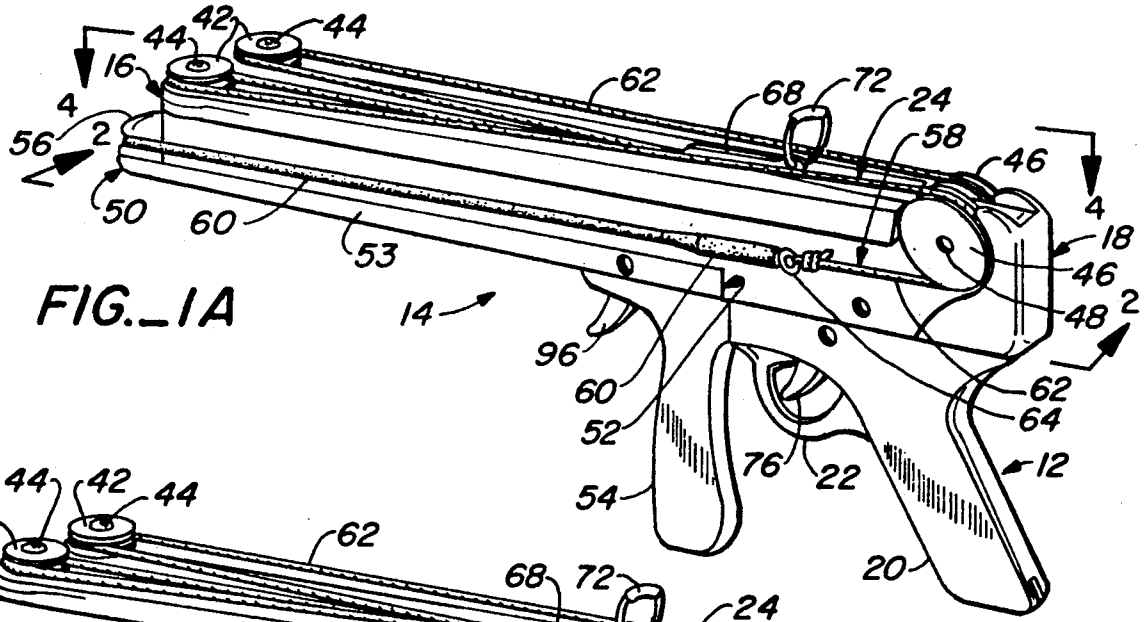
FIG. 1A is the apparatus of FIG. with one of its cocking mechanisms, its sliding dog, fully cocked.

As is apparent from inspection of FIGS. 1, 1A and 1B, and as will be more fully explained below, body members 12 and 14 are slidingly engaged with one another.

First body member 12 is elongate and generally rectilinear in profile, having a forward end 16 and a rearward end 18. First hand grip 20 protrudes downward, or depends, from first member 12's rearward end, and a loop-shaped trigger guard 22 extends immediately forward of grip 20 near where the grip meets body member 12. An elongate track portion 24 is placed above and extends generally horizontally forward of grip 20. As can be seen in the cross-sectional view of FIG. 3, track portion 24 includes an upper channel 26 running substantially the entire length thereof. Upper channel 26 is closed at its rearward end. Its forward end is open, but may be closed as necessary, as discussed below. Upper channel 26 opens to track portion 24's upper surface, its interior being cross-shaped in cross-section.

The undersurface of track portion 24 includes a pair of parallel depending side walls 28. Each side wall 28 has an inward-turned, right angled edge 30 running the length of its lower extreme. Thus, walls 28 and edges 30 describe opposing L-shapes in cross-section, and a downwardly-opened lower channel 32 is defined thereby.

The central undersurface of the forward part of track portion 24 defines the upper interior surface of lower channel 32. This surface 34 is toothed over a substantial portion of the forward end of its length. Each tooth 36 has an inclined rearward face 38. Each tooth 36 also has a forward face 40 that is substantially transverse to apparatus 10's length.

A pair of pulleys is mounted adjacent the forward end of track portion 24, each such pulley being identified with reference numeral 42 and being generally referred to herein as a forward pulley. Forward pulleys 42 are mounted so as to flank upper channel 26 adjacent its forward end. That is, channel 26 runs between pulleys 42. Pulleys 42 are mounted on a pair of pins 44, pins 44 being oriented on a pair of parallel axes generally perpendicular to the plane of the upper surface of track portion 24. Pins 44 are placed equidistant from channel 26 on a line transverse to the length of apparatus 10. Thus, pins 44 are also placed equidistant from forward end 16 of first body member 12. Pulleys 42 are disposed so as to rotate in a common plane, said plane being parallel to the upper surface of track portion 24.

A pulley is also mounted on each of the upper, opposing, rearward sides of the track portion 24 of first body member 12, each such pulley being identified with reference numeral 46 and being generally referred to herein as a rearward pulley. Rearward pulleys 46 rotate on coaxially-aligned pins 48, the common axis of pins 48 being oriented generally parallel to the plane of the upper surface of track portion 24, and perpendicular to apparatus 10's length. Thus, pulleys 46 are disposed so as to rotate in generally parallel planes, said planes being perpendicular to the plane of the upper surface of track portion 24.

Pulleys 42 and 46 constructed of laminated acrylic have been used with success in practicing the invention.

Forward pulleys 42 and rearward pulleys 46 are preferably placed so that a tangent to the curve at the outermost point of the groove of a forward pulley aligns with a tangent to the curve at the uppermost point of the groove of the rearward pulley.

Figure 3:
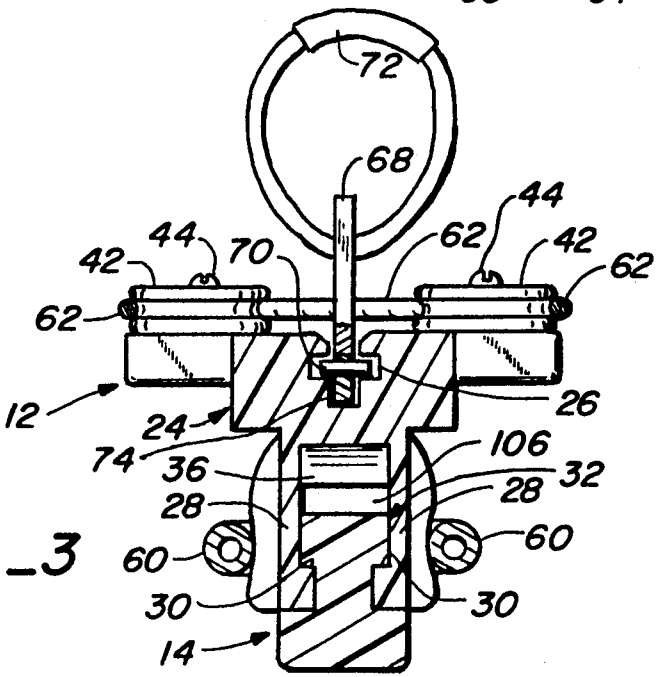
FIG. 3 is a transverse sectional view of the apparatus, along lines 3—3 of FIG. 1.

Second body member 14 is elongate and generally rectilinear in profile, having a forward end 50 and a rearward end 52. Second hand grip 54 depends from second body member 14's rearward end 52. And, toward its forward end 50 it has a portion 53 that is generally I-shaped in cross-section as best seen in FIG. 3. Therein, it is also apparent that second body member 14's I-shape permits it to slide snugly between the side walls 28 and the right-angled lower edges 30 of the forward end 16 of first body member 12.

A generally horizontal groove or seat 56 for a resilient tubular member is provided at the forward extreme of second body member 14. Seat 56 is preferably aligned with a tangent to the curve at the lowermost point of the groove of the rearward pulley.

A contiguous flexible loop member 58, comprised of a length of linearly resilient tube 60 and a length of string 62, is seated at seat 56. Opposing lengths of tube 60 of loop 58 extend rearwardly from seat 56. Lengths of string 58 extend therebeyond, around rearward pulleys 46, then forwardly and around forward pulleys 42 to meet and close loop 58.

Resilient tube 60 is preferably made of neoprene, or the like. And, string 62 is preferably of the type commonly used to string a long bow, one variety used with success being comprised of Dacron® fiber.

Eyelets 64 provide convenient means for binding tube 60 to string 62.

Where string 62 of loop 58 is wrapped around forwardly of forward pulleys 42, a short segment of string 62 spans the space between pulleys 42 directly over upper channel 26. This string segment (unnumbered) passes through an aperture 66 in the forward end of sliding dog 68, dog 68 being slidingly engaged with upper channel 26. It may be desirable to close the forward end of channel 26 to prevent sliding dog 68's exit therefrom.

Forward pulleys 42 should be close enough together such that, if sliding dog 68 is drawn rearward, segments of string 62 follow tangents to the curves at the innermost points of the grooves of pulleys 42. That is, such segments should be generally parallel to each other, as well as to the length of apparatus 10.

Figure 2:
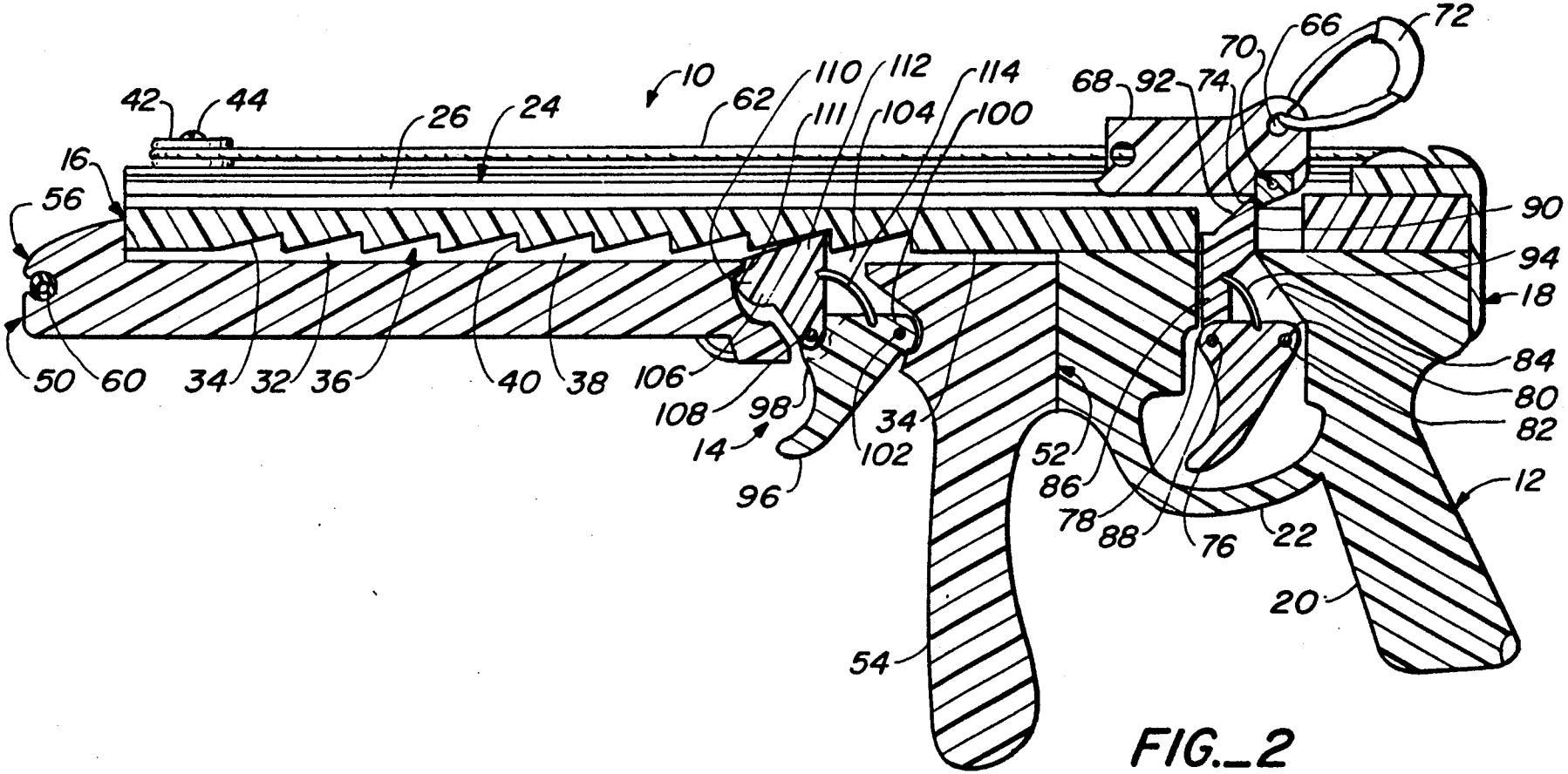
FIG. 2 is a longitudinal sectional view of the apparatus, along lines 2—2 of FIG. 1A.
Figure 2A:
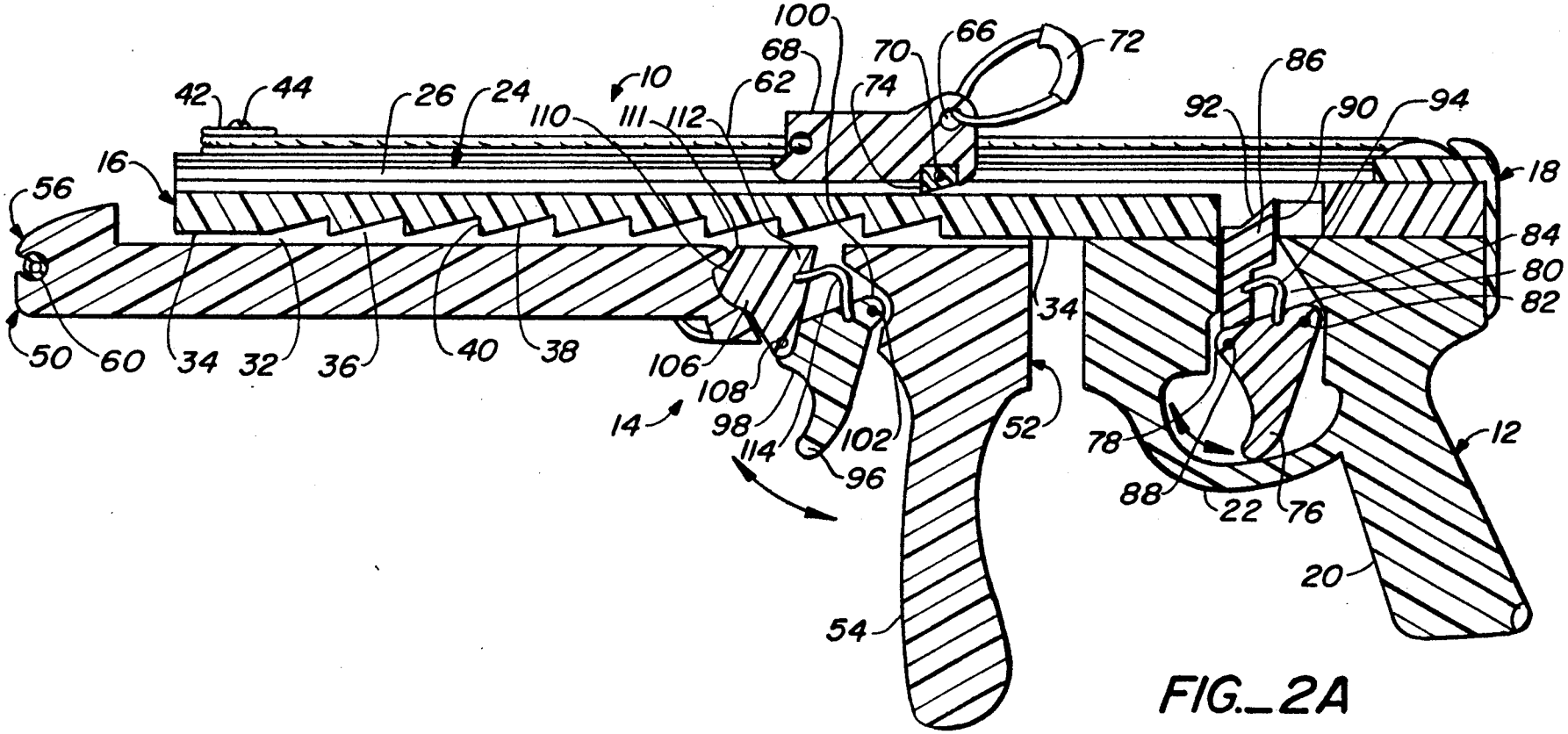
FIG. 2A is a longitudinal sectional view of the apparatus an instant after the rear trigger is pulled, both cocking mechanisms of the apparatus having been fully cocked as in FIG. 1B.

As shown in FIG. 3, sliding dog 68 has a cross-shaped lower portion which conforms to the like-shaped cross-sectional shape of channel 26. Cross pin 70 gives the lower portion of sliding dog 68 its cross shape. Thus, sliding dog 68 is able to move forwardly and rearwardly in channel 26, but is not able to move transversely thereto. Pull ring 72, attached to the upper rear of sliding dog 68, is provided to aid in drawing dog 68 rearwardly against resistance from loop 58. And, as shown in FIGS. 2, 2A and 3, a step 74 depends from dog 68's lower extreme near its rearward end. Step 74 depends to the lowest extreme of cross-shaped upper channel 26, having a forward face oriented at 90° to the length of upper channel 26. Rearward from its forward face, step 74's lower surface curves gently up and away toward the rear of dog 68.

Steel has been used with success in fashioning a sliding dog for use in the context of the present invention. And, any strong flexible cord or strap-like material may be employed in the construction of pull ring 72.

Just forward of hand grip 20 on first body member 12, trigger guard 22 shields a first trigger 76. Trigger 76 has forward and rearward lobes 78 and 80, respectively. Trigger 76 pivots, on pin 82 through its rearward lobe 80, inside cavity 84 of first body member 12. Pin 82 is fixed to body member 12 and, in a transverse orientation to apparatus 10's length, spans cavity 80.

First sear 86, in turn, is pivotally bound to the forward lobe 78 of trigger 76 with pin 88. Sear 86 is generally elongate and stands upright from forward trigger lobe 78; its upper terminus projects into upper channel 26. As shown in FIG. 2, the upper rearward face 90 of sear 86 is planar to its upper terminus. However, forward face 92 is angled rearwardly. A first arced metallic spring 94 spans the right angle between trigger 76 and rearward face 90 of sear 86.

A second trigger 96 is also provided, this being in second body member 14. Trigger 96 has forward and rearward lobes 98 and 100, respectively, and pivots on pin 102 through rearward lobe 100, inside cavity 104 of second body member 14. Pin 102 is fixed to body member 14 and spans cavity 104 in a transverse orientation.

Second sear 106 is pivotally bound to the forward lobe 98 of trigger 96 with pin 108. Sear 106 is generally triangular and stands upright from forward trigger lobe 98. As shown in FIG. 2, forward upper corner 110 of sear 96 is concave and bears against a protrusion 111 on the inner wall of cavity 104. And, as shown in FIGS. 2, 2A and 3, sear 106's rearward upper corner 112 projects into lower channel 32. A second arced metallic spring 114 spans the right angle between trigger 96 and a point just below rearward upper corner 112 of sear 106.

Laminated acrylic is one material used with success in fashioning triggers 76 and 96, and sears 86 and 106, for use in the context of the present invention. And, spring steel has been used with success in fashioning arced metallic springs 94 and 114 for use with this invention.

Figure 5:
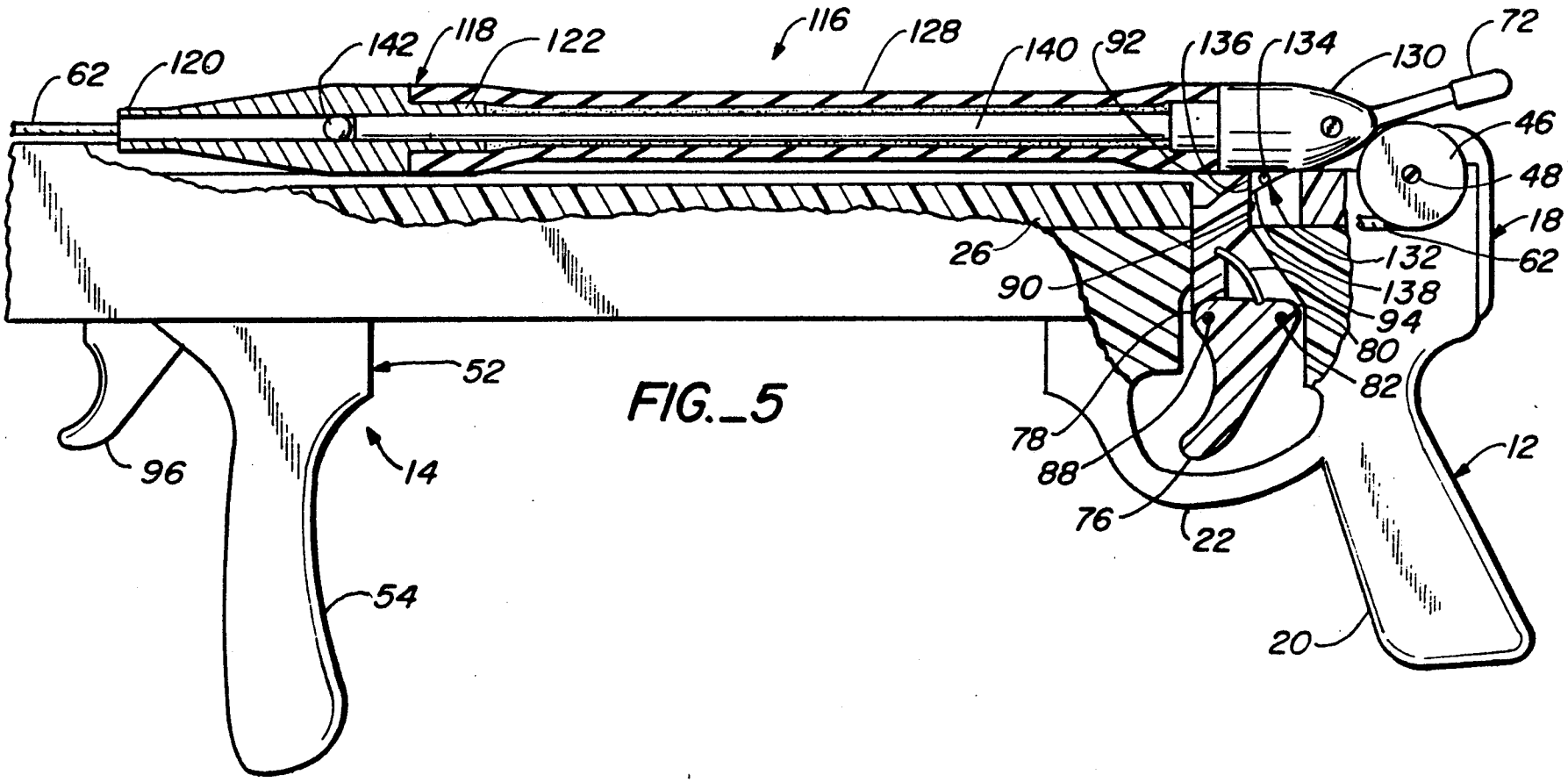
FIG. 5 is a fragmentary, partly cut away side elevation of the rearward end of an alternative embodiment of the apparatus including a velocity increasing mechanism, the mechanism being cocked and ready to project a spherical pellet.
Figure 6:
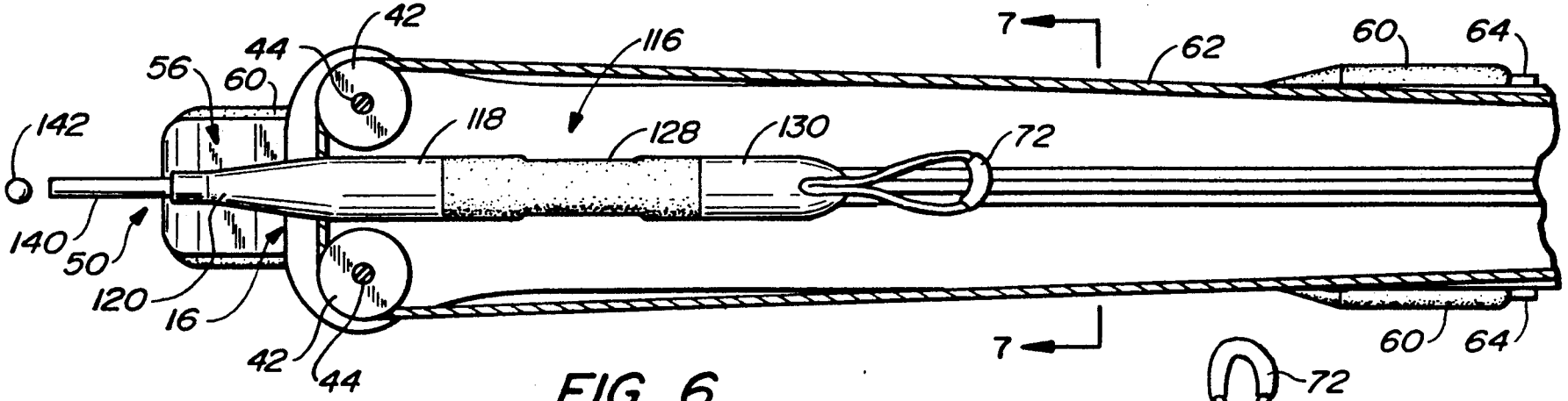
FIG. 6 is an enlarged, fragmentary plan view of the forward end of the alternative embodiment of FIG. 5, the velocity increasing mechanism being shown projecting a spherical pellet.
Figure 7:
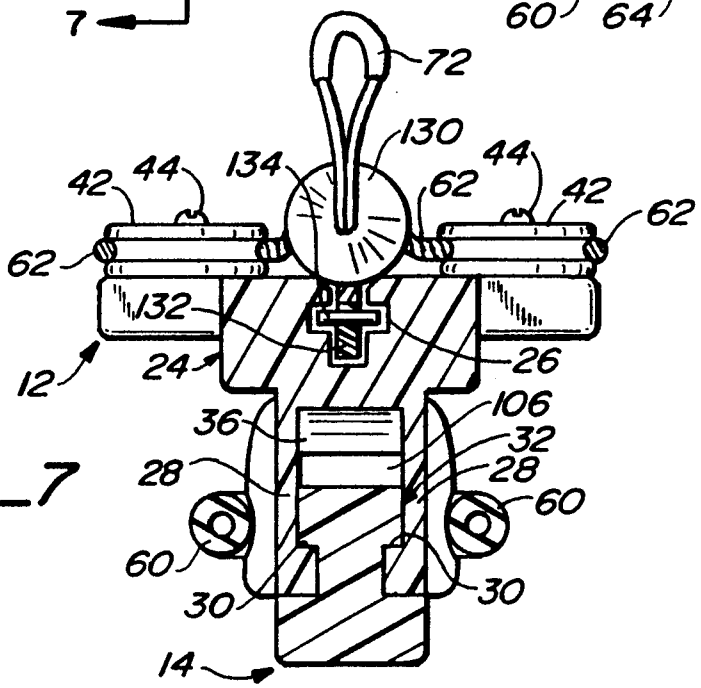
FIG. 7 is a fragmentary, transverse sectional view, along lines 7—7, of the velocity increasing mechanism of FIG. 6.

FIGS. 5, 6 and 7 show a velocity increasing mechanism 116 adapted to work in concert with the foregoing mechanical shooting apparatus 10. Mechanism 116 essentially replaces sliding dog 68, running in upper channel 26. Mechanism 116 first includes a rigid ferrule 118 bound between opposing ends of string 62 in loop 58. As shown in FIG. 5, ferrule 118 is tubular and has a forward end 120 and a rearward end 122. Guide tab 124 protrudes downward into upper channel 26. When no tension is being placed on loop 58, ferrule 118 resides approximately between forward pulleys 42 as in FIG. 6.

A length of resilient tube 128 is fixed in coaxial relation to ferrule 118 at its rearward end 122. Tube 128 has an inside diameter similar to that of ferrule 118. Tube 128 may be of neoprene, or the like, and may be fixed to ferrule 118 by conventional means.

A rigid cap 130 is fixed to the rearward end of tube 128. Cap 130 has a pull ring 72 at its rearward end similar to that shown on sliding dog 68. A spur 132 depends from cap 130 into upper channel 26 and has a cross pin 134 to prevent cap 130's movement transverse to the channel. Spur 132 has a forward face 136 oriented at 90° to the length of upper channel 26, and a rearward face 138 that curves up and away from the lower extreme of forward face 136.

FIGS. 5 and 6 show a rod 140 inside ferrule 118 and tube 128, and seated in cap 130. In one embodiment of the velocity increasing mechanism adapted to project a pellet 142, rod 140 is rigidly fixed to the inside of cap 130. Rod 140 may be fixed into cap 130 by any conventional means, such as by providing mating screw threads between them. However, in an alternative embodiment of the velocity increasing mechanism, rod 140 may be freely resting inside cap 130; i.e. not fixed to the cap's interior. Thus, rod 140 is caused to act as a spear or other similar elongate projectile in the context of such alternative embodiment. Rod 140, whether fixed or free within cap 130, should be of sufficient length such that when tube 128 is axially elongated, some portion of rod 130's forward end remains within ferrule 118.

It may be expedient to magnetize the forward end of rod 140 to facilitate its use with pellets of ferrous composition.

Figure 4:
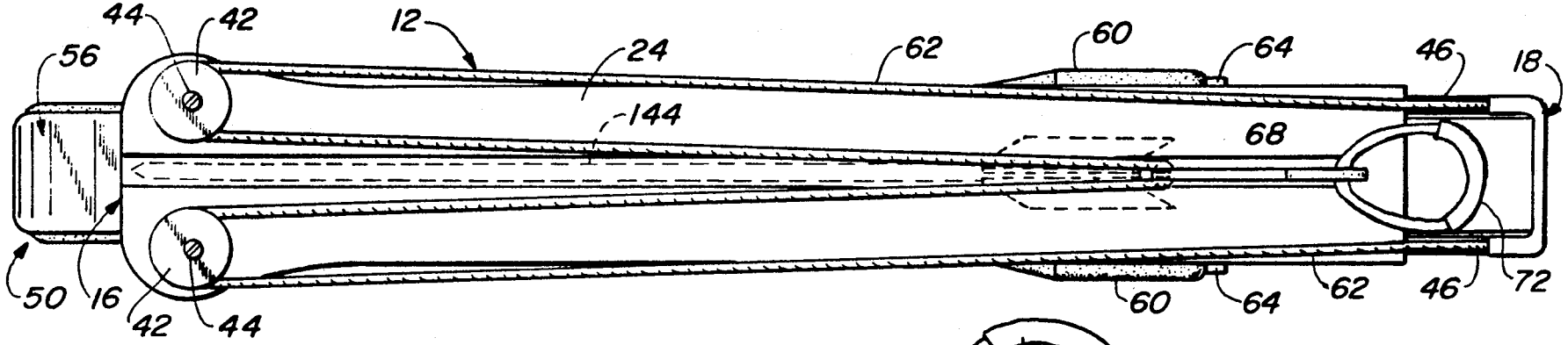
FIG. 4 is a plan view of the apparatus cocked as in FIG. 1A and readed to project an arrow.

In use, apparatus 10, as shown in FIGS. 1 through 4 without a velocity increasing mechanism, has several possible modes of operation. In one preferred mode, apparatus 10 is cocked as shown in FIGS. 1A and 2. Cocking first trigger 76 requires that sliding dog 68 be pulled rearward with pull ring 72 until step 74 catches on the upper end of rearward face 90 of first sear 86. Then, as shown in FIG. 4, an arrow 144 is laid into channel 26 in the upper surface of track portion 24. If first trigger 76 is pulled rearwardly, first sear 86 is pulled downward, suddenly releasing dog 68. This causes arrow 144 to be projected, ahead of dog 68, in a forward direction from apparatus 10.

Figure 1B:
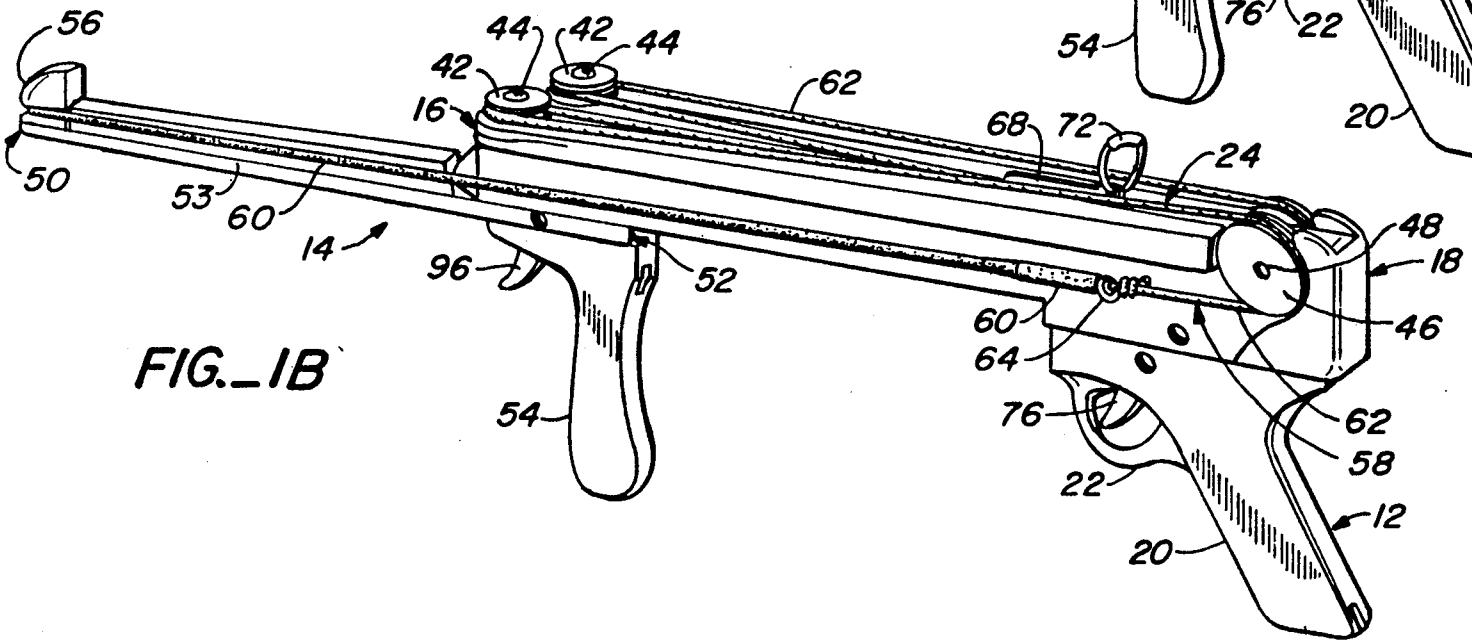
FIG. 1B is the apparatus cocked as shown in FIG. 1A and additionally having the other of its cocking mechanisms, its connectedly displaceable primary and secondary body members, fully cocked.

In another preferred mode of use, apparatus 10 is cocked as shown in FIG. 1B. That is, second body member 14 is slidingly moved forward from first body member 12 after first being cocked as in FIG. 1A. As suggested in FIG. 2A, body members 12 and 14 are held in such relation to each other, i.e. in a cocked position, by the interaction of second sear 106 with a tooth 36 in the upper interior surface 34 of lower channel 32. As surface 34 is toothed over a substantial portion of the forward end of its length, second sear 106's rearward upper corner 112 may catch on and bear against any planar forward face 40 of any tooth 36, thus providing a substantial range of adjustment of tension on loop 58. By this action, additional tension is placed on loop 58 over that generated by the first cocking mode of FIG. 1A. And, a greater potential to impart forward motion to arrow 144 is created, as well. Pulling trigger 76 releases sliding dog 68 and projects arrow 144 in a forward direction.

Thus, it should be apparent from the foregoing that two cocking stages are possible in use of apparatus 10. In the first as in FIG. 1A, the finger is used in drawing back pull ring 72 until dog 68 catches on first sear 76. Finger strength is sufficient to elongate loop 58 in its first stage of stretching. In the second cocking stage shown in FIG. 1B, arm strength is used to separate first and second hand grips 20 and 54. Arm strength is needed because considerably more tension is required to elongate loop 58 beyond the stage shown in FIG. 1A. However, a projectile may be projected forward when the apparatus is set in either of the two cocking stages.

It should be particularly noted that in this mode of use second trigger 96 should not be pulled while apparatus 10 is cocked as in FIG. 1B, because this could cause body member 14 to slam rearward against first body member 12. Proper use dictates that second trigger 96 not be released until after first trigger 76 has been pulled and arrow 144 has been projected forward.

Two other incidental modes of use of apparatus 10, as shown in FIGS. 1 through 4, are also possible. In a first, a contiguous flexible loop member shorter than loop 58, but similarly comprised of a linearly resilient tube and a length of string, may have its tube portion seated at seat 56 and its string attached to sliding dog 68. However, this shorter loop member is not wrapped around pulleys 42 and 46; it stretches directly between seat 56 and dog 68. Cocking simply requires dog 68 to be pulled rearwardly until it catches on first sear 86. Releasing first trigger 76 then accelerates any projectile such as arrow 144 in a forward direction ahead of dog 68.

The second incidental mode of use is carried out using the shortened loop member arranged as described in the context of the first incidental mode. However, a second stage of cocking is employed in this mode, said cocking being accomplished as second body member 14 is slidingly moved forward from first body member 12. Body members 12 and 14 are held in such relation to each other by the interaction of second sear 106 with a tooth 36 in the upper interior surface 34 of lower channel 32. Second sear 106 may catch on and bear against any tooth 36 in channel 32, thus providing a substantial range of adjustment of tension on the shortened loop. As usual, releasing first trigger 76 then accelerates a projectile in a forward direction ahead of dog 68.

Although arrow 144 is used as an example of a projectile able to be accelerated by the embodiments shown in FIGS. 1 through 4 of the invention, it is also noted that slight modifications permit use of a ferrous pellet as a projectile, as well. One such modification is the substitution of sliding dog 68 with a like-shaped dog made of magnetized metal. And, another is the placement of one strip of magnetized metal on either side of the upper opening of channel 26 of track 24. These modifications aid in binding such a pellet to apparatus 10 as it is being accelerated. Upper channel 26 may also be trough-shaped at its upper opening to further accommodate such a pellet, as shown in FIG. 3.

It should also be noted that one may not depart from the spirit of the invention by eliminating sliding dog 68, merely grasping a short segment of string spanning the space between forward pulleys 42 directly over upper channel 26 and drawing that segment rearward to create potential for accelerating a projectile. Neither is a trigger mechanism essential to the operation of the invention, because one may simply draw pull ring 72, or even a string segment itself, rearwardly with a finger and release it as desired.

Wherein velocity increasing mechanism 116 is added to apparatus 10 as in FIGS. 5, 6 and 7, two optional modes of use are presented. If it is desired that a rod-like projectile such as a spear be projected, velocity increasing mechanism 116 is simply cocked as in FIG. 5 and a rod 140 is inserted into the coaxial bores of ferrule 118 and tube 128. The rearward end of rod 140 simply rests in cap 130; rod 140 must be free to fly forward if trigger 76 is released. Of course, rod 140 may be fitted with an appropriately sharpened point, or the like. Second-stage cocking is also shown in FIG. 5; i.e., second body member 14 is separated from first body member 14 in a similar manner to that shown in FIG. 1B.

In the alternative mode of use of velocity increasing mechanism 116, rod 140 is fixed, by threaded or other means, into cap 130 so it acts as a ramrod or plunger in the bore of ferrule 118. Once cocked as in FIG. 5, pellet 142 may be inserted into ferrule 118's bore. As suggested above, retention of pellet 142 in ferrule 118's bore may be facilitated if pellet 142 is of a ferrous composition and the forward end of rod 140 is magnetized.

It is noted that velocity increasing mechanism 116 may also be used with other types of mechanical shooting apparatus. As long as such other apparatus has a primary accelerator to which mechanism 116 may be fixed, mechanism 116 will add a potential for an increased length of draw and an ability to impart increased acceleration to a projectile. Such a primary accelerator to which mechanism 116 may be fixed may be any familiar band, tether, tube, dog, carriage, or the like, commonly used in mechanical shooting apparatus to accelerate a projectile. As long as mechanism 116 is able to be fixed to such primary accelerator, increased performance may be expected from the shooting apparatus of which the accelerator forms a part.

The foregoing detailed disclosure of the inventive mechanical shooting apparatus 10 is considered as only illustrative of the preferred embodiment of, and not a limitation upon the scope of, the invention. Those skilled in the art will envision many other possible variations of the structure disclosed herein that nevertheless fall within the scope of the following claims. And, alternative uses for this inventive device may later be realized. Accordingly, the scope of the invention should be determined with reference to the appended claims, and not by the examples which have herein been given.

I claim:

1. Apparatus for shooting a projectile, said apparatus comprising:

a. a first elongate body member having a forward end and a rearward end;

b. a rearward pair of pulleys mounted in opposed relation on said first body member adjacent its rearward end;

c. a forward pair of pulleys mounted in opposed relation on said first body member adjacent its forward end;

d. a second elongate body member having a forward end and a rearward end, said second body member being connectedly displaceable from said first body member; and, e. a substantially contiguous flexible loop member, at least a segment of which is linearly resilient, said loop being seated against said forward end of said second body member, opposing lengths thereof extending rearwardly and around said rearward pulleys of said first body member, then forwardly and around said forward pulleys to meet and close said loop, whereby a short segment on said loop may be drawn rearwardly from between said pulleys of said forward pulley pair creating a potential for accelerating a projectile in a forward direction, and whereby connected displacement of said first body member from said second body member adds tension to said loop and yields an increased potential to accelerate said projectile.

2. The shooting apparatus of claim 1, further including means for suddenly releasing said short segment on said loop.

3. The shooting apparatus of claim 1, wherein said forward pulleys are oriented generally in a common plane.

4. The shooting apparatus of claim 1, wherein each pulley of said rearward pulley pair is oriented in a plane generally parallel to the plane of the other.

5. The shooting apparatus of claim 1, wherein said forward pulleys are oriented generally in the same plane, and wherein each pulley of said rearward pulley pair is oriented in a plane generally parallel to the plane of the other.

6. The shooting apparatus of claim 1, wherein said first, and second elongate body members each has a hand grip protruding therefrom.

7. The shooting apparatus of claim 1, further including velocity-increasing mechanism comprising a. a resilient, quickly retractable member affixed to said loop member at said short segment; and, b. means associated with said retractable member for imparting forward motion to a projectile in response to retraction of said retractable member after being stretched.

8. The shooting apparatus of claim 7, further including means for permitting said selective restraining and releasing means to restrain and release said forward motion imparting means.

9. Apparatus for shooting a projectile, said apparatus rising:

a. a first elongate body member having a forward end and a rearward end;

b. a second elongate body member having a forward end and a rearward end, said second body member being connectedly displaceable from said first body member;

c. a substantially contiguous flexible loop member, at least a segment of which is linearly resilient, said loop being seated against said second body member's forward end;

d. means on said first body member for selectively restraining and releasing a short segment on said loop whereby, when restrained, connected displacement of said first body member from said second body member adds tension to said loop and yields a potential to accelerate a projectile in a forward direction;

e. a rearward pair of pulleys mounted in opposed relation adjacent said first elongate body member's rearward end; and, f. a forward pair of pulleys mounted in opposed relation adjacent said first elongate body member's rearward end, opposing lens of said loop member extending rearwardly and around said rearward pulleys, then forwardly and around said forward pulleys to meet and close said loop.

10. The shooting apparatus of claim 9, wherein said forward pulleys are oriented generally in a common plane.

11. The shooting apparatus of claim 9, wherein each pulley of said rearward pulley pair is oriented in a plane generally parallel to said plane of the other.

12. The shooting apparatus of claim 9, wherein said forward pulleys are oriented generally in the same plane, and wherein each pulley of said rearward pulley pair is oriented in a plane generally parallel to the plane of the other.

13. A velocity-increasing mechanism for use with mechanical shooting apparatus having primary means for accelerating a projectile, said velocity-increasing mechanism comprising:

a. a ferrule affixed to said shooting apparatus' primary means for accelerating a projectile, said ferrule having forward and rearward ends, said ferrule's forward end correspond to that end of said apparatus from which a projectile departs;

b. a length of resilient tube bound to said ferrule in coaxial relation therewith at said ferrule's rearward end;

c. means associated with said tube for imparting forward motion to a projectile in response to retraction of said tube after being stretched; and, d. means exterior to said rearward end of said tube for permitting said end to be selectively restrained and released whereby, when restrained, projectile accelerating potential is increased over such potential in said shooting apparatus' primary accelerating means.

14. The mechanism of claim 13 wherein said forward motion imparting means comprises means interior to said rearward end of said tube for seating an arrow.

15. The mechanism of claim 14 wherein said forward motion imparting means comprises a rod, the forward end of said rod being axially slidingly received in said ferrule, the rearward end of said rod being fixed interior to said rearward end of said tube, said rod being of sufficient length such that when said tube is axially elongated, said rod's forward end remains in said ferrule.

* * * * *